US010537484B2

(12) United States Patent
Levine

(10) Patent No.: US 10,537,484 B2
(45) Date of Patent: Jan. 21, 2020

(54) WHEEL CHAIR LIFTING DEVICE

(71) Applicant: Marc D. Levine, Santa Clarita, CA (US)

(72) Inventor: Marc D. Levine, Santa Clarita, CA (US)

( * ) Notice: Subject to any disclaimer, the term of this patent is extended or adjusted under 35 U.S.C. 154(b) by 719 days.

(21) Appl. No.: 14/999,780

(22) Filed: Jun. 27, 2016

(65) Prior Publication Data

US 2017/0367914 A1 Dec. 28, 2017

(51) Int. Cl.
*A61G 5/10* (2006.01)

(52) U.S. Cl.
CPC ..... *A61G 5/104* (2013.01)

(58) Field of Classification Search
CPC ..... A61G 5/10; A61G 5/104; A61G 5/068; A61G 3/02; A61G 3/0209; A61G 3/063
See application file for complete search history.

(56) References Cited

U.S. PATENT DOCUMENTS 3,476,404 A * 11/1969 Rachman ..... A61G 3/063 280/30
3,888,463 A * 6/1975 O'Brien ..... A61G 3/063 187/900
4,084,830 A * 4/1978 Daniel, Jr. ..... B60S 9/06 254/420
4,725,183 A * 2/1988 Smillie, III ..... B60R 5/04 187/244
4,759,684 A * 7/1988 Lanzillotta ..... A61G 5/104 187/200
4,916,933 A * 4/1990 Celette ..... B21D 1/14 187/216
4,941,799 A * 7/1990 Gordon ..... A61G 5/104 254/124
4,984,657 A * 1/1991 Burns ..... B66F 7/025 187/207
5,105,915 A * 4/1992 Gary ..... A61G 3/063 14/71.3
5,211,264 A * 5/1993 Beattie ..... B66F 7/04 187/208
5,230,522 A * 7/1993 Gehlsen ..... A61G 3/063 180/8.2
5,421,692 A * 6/1995 Varrichio ..... A61G 5/104 187/200
6,269,676 B1 * 8/2001 Soyk ..... B66F 7/0641 72/457
6,547,509 B1 * 4/2003 Edmo ..... B66F 7/0641 187/269

(Continued)

*Primary Examiner* — Peter M. Cuomo
*Assistant Examiner* — Ifeolu A Adeboyejo

(57) ABSTRACT

A wheel chair lifting device with a stationary platform, a movable lift assembly, four motorized scissors jacks, a foot stand platform, a battery power supply and a wireless lift controller and receiver. The four scissors jacks each placed on one corner of the stationary platform. The movable lift assembly is attached at each corner to the for scissors jacks. The movable assembly can of be lifted and lowered by the four scissors jacks. The scissors jacks are powered by the battery power supply. The motors of the lift jacks are activated by a wireless hand held controller. The base of the movable lift assembly is level with the stationary platform so that no ramp is required for rolling a wheel chair onto the lift assembly.

6 Claims, 8 Drawing Sheets

(56) References Cited

U.S. PATENT DOCUMENTS

| | | | | |
|---|---|---|---|---|
| 6,695,289 | B1 * | 2/2004 | Mickael | B66F 3/12 187/211 |
| 7,896,134 | B2 * | 3/2011 | Morris | A61G 3/063 187/200 |
| 8,239,988 | B2 * | 8/2012 | Brenner | A47C 16/025 5/648 |
| 2003/0213653 | A1 * | 11/2003 | Morris | B66B 9/0853 187/269 |
| 2004/0161321 | A1 * | 8/2004 | Blake | B62B 1/002 414/444 |
| 2006/0120837 | A1 * | 6/2006 | Hung | A61G 3/063 414/347 |
| 2008/0042114 | A1 * | 2/2008 | Stanislao | B66B 9/083 254/89 R |
| 2008/0250984 | A1 * | 10/2008 | Panzarella | A61G 3/0209 108/44 |
| 2009/0278098 | A1 * | 11/2009 | Bacon | B66F 7/0625 254/1 |
| 2013/0111660 | A1 * | 5/2013 | Wilson | A61G 7/10 5/86.1 |
| 2015/0231002 | A1 * | 8/2015 | Gierse | A61G 5/1059 297/344.16 |

* cited by examiner

WHEEL CHAIR LIFTING DEVICE

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of wheel chair accessories and more specifically to a wheel chair lifting device.

Disabled or injured persons sometimes to not have proper use of their legs and therefore need the assistance of a wheel chair. Occasionally, the injured or disabled person needs to be lifted to a higher elevation for example when needing to be transferred to a medical exam table, or to be transferred into a vehicle. Prior to the present invention, moving patients from a wheelchair at a first elevation to a bed or gurney at second or higher elevation required the healthcare staff to physically lift the patient from the wheelchair to the bed or gurney. This moving process requires much physical exertion and can put both the staff member and the patient at risk for injury. There remains a need to provide an apparatus to raise the wheelchair to the same elevation or a slightly higher elevation to facilitate the transfer of the patient to or from the bed or gurney, exam table, X ray table, or even a chair.

Various wheel chair lifts have been developed, such as the one patented by Ingamar Svenson in his U.S. Pat. No. 4,958,979 that is mounted within a van type vehicle and extends out of the vehicle and down to the ground, for the wheel chair to roll onto and be lifted into the van. However, the Svensson invention is rather heavy and requires a significant support structure that is mounted within the van. There are times when it would be very helpful to have the use of a wheel chair lifter that is relatively light weight and portable so that is can be conveyed to any location where a wheel chair can be easily rolled onto a lift and the lift can raise to the desired height to transport a person from the wheel chair to another location such as an exam table or vehicle. Additionally, it would be helpful if the lifting device included a foot standing platform so that the user can be helped to stand on the raised platform when being transferred to another location.

BRIEF SUMMARY OF THE INVENTION

The primary object of the invention is to provide a wheel chair lifting device that can lift the chair and its occupant from ground level to approximately fourteen inches above the ground.

Another object of the invention is to provide a wheel chair lifting device that is portable and light weight enough to be carried by one person.

Another object of the invention is to provide a wheel chair lifting device that is battery operated.

A further object of the invention is to provide a wheel chair lifting device that allows the occupant of the chair to stand up while in the lifted position.

Yet another object of the invention is to provide a wheel chair lifting device that locks the chair in place during lifting.

Still yet another object of the invention is to provide a wheel chair lifting device that allows the chair to be rolled onto the low profile lifting platform without the need for a ramp.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed a wheel chair lifting device comprising: a stationary platform, a movable lift assembly, four motorized scissors jacks, a foot stand platform, a battery power supply, a wireless lift controller and receiver, said four scissors jacks each placed on one corner of said stationary platform, said movable lift assembly attached at each corner to said for scissors jacks, said movable assembly capable of being lifted and lowered by said four scissors jacks, said scissors jacks being powered by said battery power supply, and said motors of said lift jacks being activated by a wireless hand held controller.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
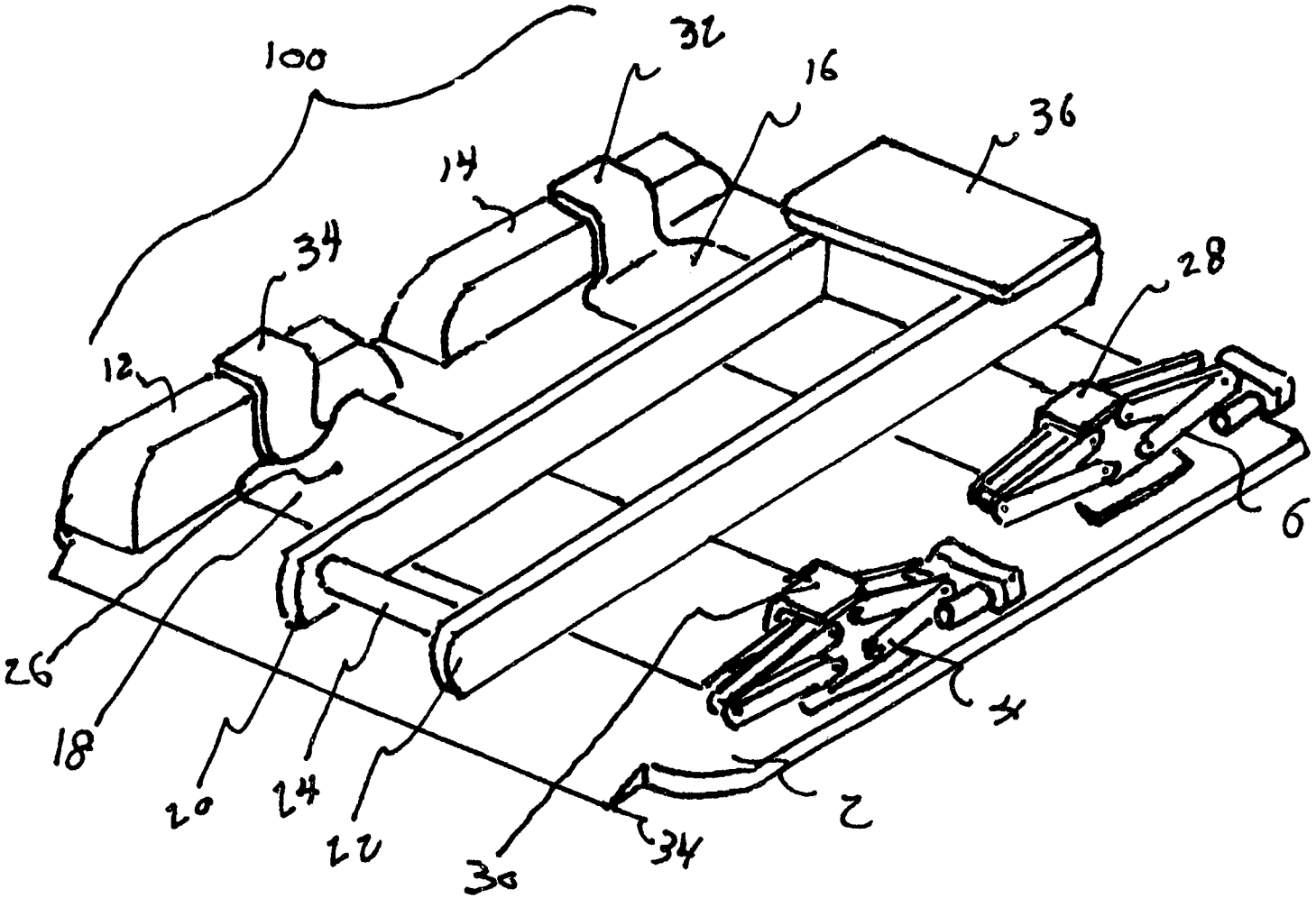
FIG. 1 is a perspective view of the invention in the lowered portion.

Referring now to FIG. 1 we see a perspective view of the invention 100 in the lowered position. A support plate 2 sits on the ground. Four motorized scissors jacks 4, 6 are shown, and jacks 8 and 10 are hidden under jack covers 12, 13. In the completed version of the invention 100 as shown in FIG.

Figure 4:
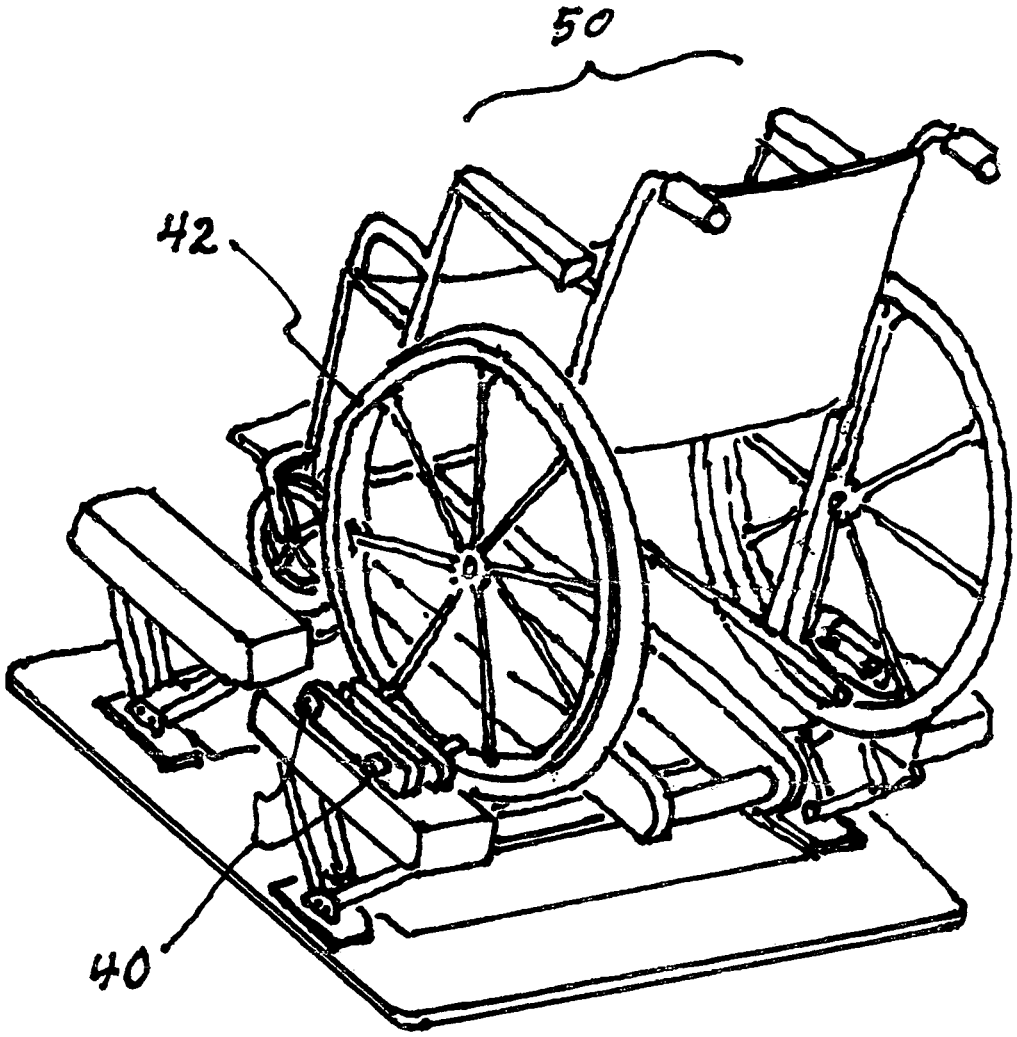
FIG. 4 is perspective view of the invention with a wheel chair in place.
Figure 5:
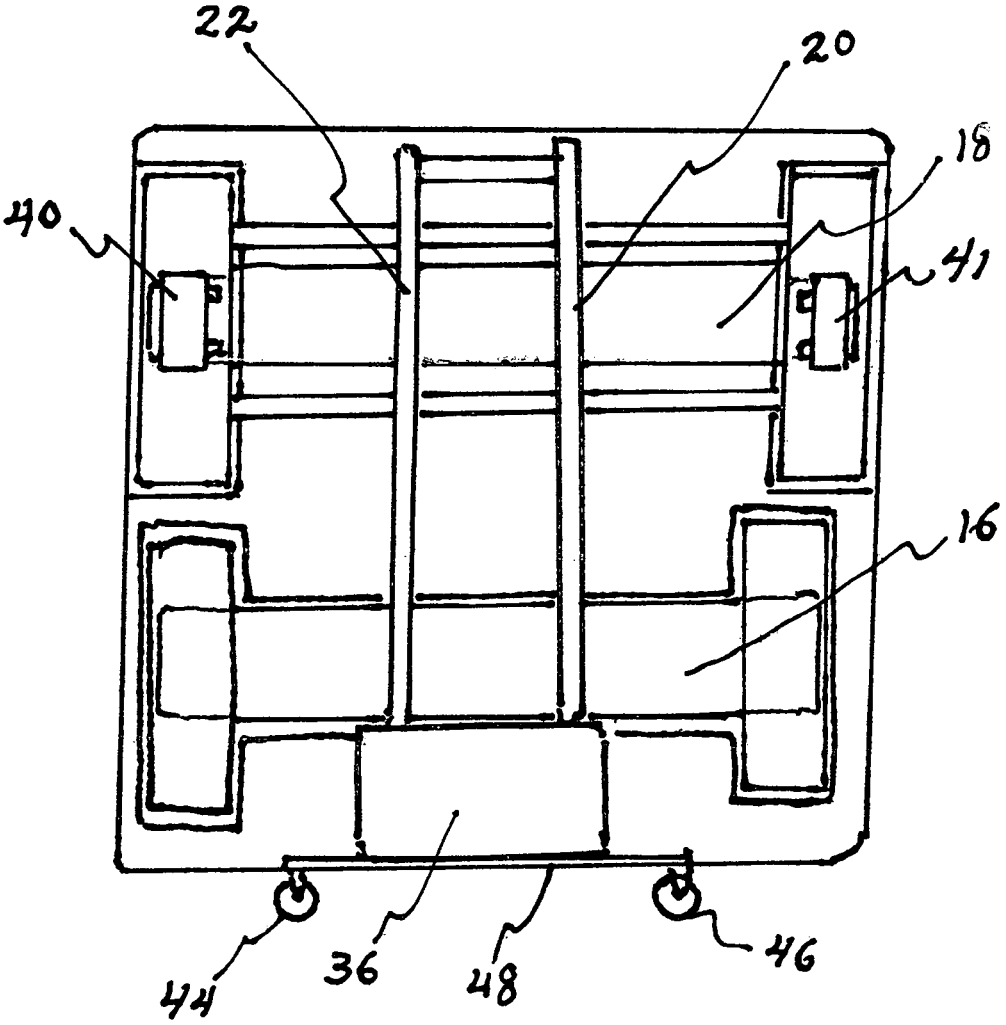
FIG. 5 is a to plan view of the invention.

4, all jacks 4, 6, 8, 10 have covers to protect the user from the moving parts of the jack. A lifting assembly is formed by forward support plate 16, rearward support plate 16 attached to longitudinal support rigid members 20, 22. A foot standing platform 36 is attached to the forward end of the support members 20, 22. Z brackets 28, 30, 32, 34 connect lifting support plates 16, 18 to the tops of jacks 4, 6, 8, 10. Main support plate 2 is only approximately one half of one inch tall with a small ramp 34 on the rear edge leading from ground level to the top of the support plate 2 making it very easy for a care giver or the user of the wheel chair to roll onto the main support plate 2. The lifting plates 16, 18 are basically flush with the top of the main support plate 2 as shown in the section view of the invention shown in FIG. 3. so the wheel chair can proceed from the rear of the main support plate 2 to the front of the support plate 2 with a minimum of effort. A concavity 26 in large wheel supporting lifting plate 18 positions the wheel chair and acts as a partial brake to help hold the wheel chair in place during use. A wheel locking mechanism 40 as shown in FIGS. 4 and 5 has fingers that slidably engage the grip ring 41 of the large wheel of the wheel chair 50. Handle portion 24 are attached between the longitudinal support members 20, 22. This allows a person to lift the entire invention, which has a weight of approximately thirty pounds, and transport it to the needed location. Casters 44, 46 shown in the top plan view in FIG. 5 are supported by a plate 48 which is perpendicularly positioned and attached to the main support plate 2 so that the entire invention can be rolled to the place of intended use.

Figure 2:
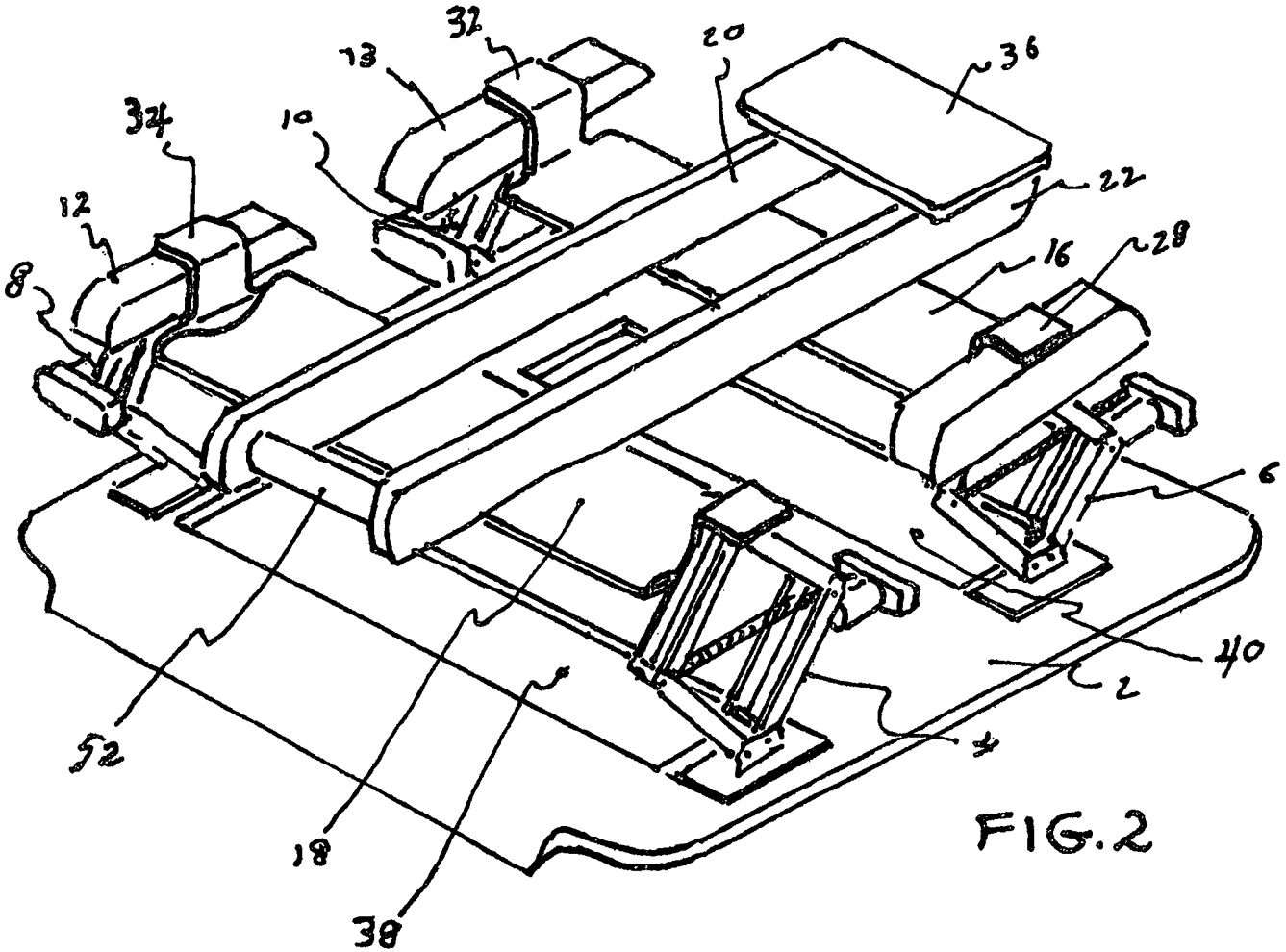
FIG. 2 is a perspective view of the invention in the raised position.

FIG. 2 shows the invention 100 in the lifted position which is approximately fourteen inches above the ground level. The position of the foot standing plate 36 is in alignment with the user's feet if and when he or she is helped to stand up while the lifting mechanism is in the raised position. Micro switches in each jack cause the motors of the jacks to turn off automatically when the jack reaches its upper most position or lower most position.

Figure 3:
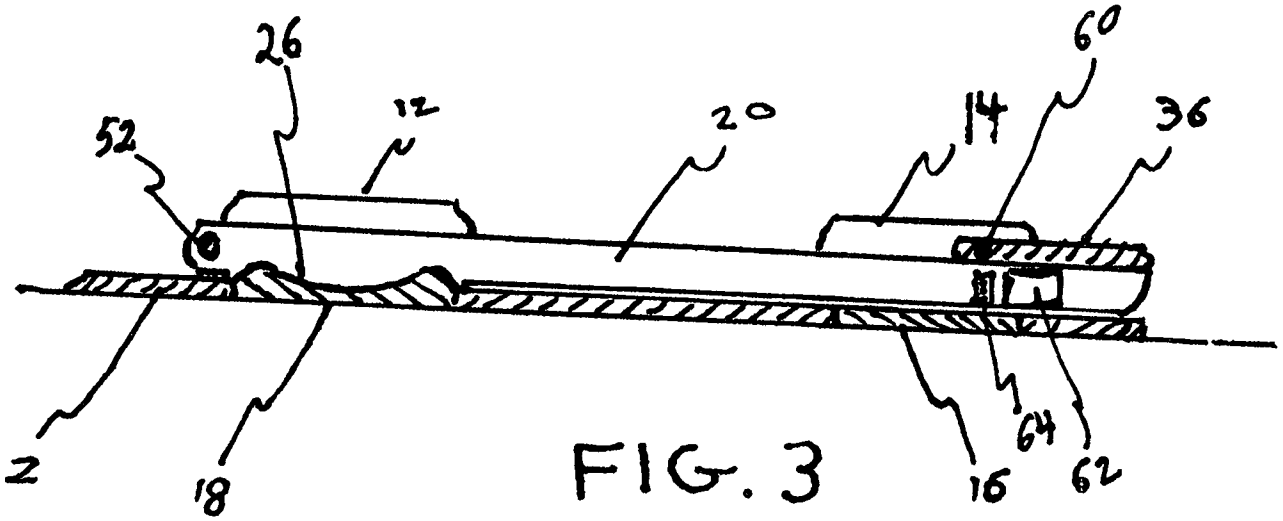
FIG. 3 is a side section view of the invention.

FIG. 3 is a side section view of the invention 100 that longitudinally bisects the main support plate 2. This view clearly shows that the lifting plates 16, 18 are flush with the top of the main support plate 2. Concavity 26 in lift plate 18 acts as a cradle for the large wheel of a wheel chair as shown in FIG. 4. This concavity locates the wheel chair and acts as a partial brake. Foot standing plate 36 can be seen as well as jack covers 12, 14. FIG. 3 also shows battery 62 which powers the jacks as well as control electronics 62. The battery 62 and control electronics 64 can be accessed by lifting the foot plate 36 via hinge member 60. The lifting action is activated by a person pressing one of two buttons on a hand held wireless transmitter. Pushing one button causes the lift mechanism to rise. Pushing the other button causes the lift mechanism to lower. The present invention is superior to other lift mechanisms in that the lifting plates are only one half of one inch from the ground, making it easy to roll a wheel chair onto the lift assembly 100 without needing an additional ramp to roll the wheel chair up onto a higher lift platform such as those found on other lifting mechanisms. Such a ramp is problematic in that it takes up significant additional space during use which may not be available in health care facilities that can most benefit from such a lift. Additionally, the lack of an extra ramp gives an overall lower weight to the entire lifting device which is important for a device that is meant to be portable and to be transported by one person of average strength.

FIG. 4 is a realistic perspective view of the invention 100 with a wheel chair 50 in place. Locking mechanism 40 can be seen in the locked position where sliding fingers of the lock 40 are engaged with the grip wheel 42 thereby preventing the wheel chair from accidentally rolling off of the support panels 16, 18. In the preferred embodiment, an identical locking mechanism is located at the opposite side of the invention 100.

FIG. 5 is a top plan view of the invention 100 clearly showing casters 44, 46 attached to perpendicular plate 48.

Figure 6:
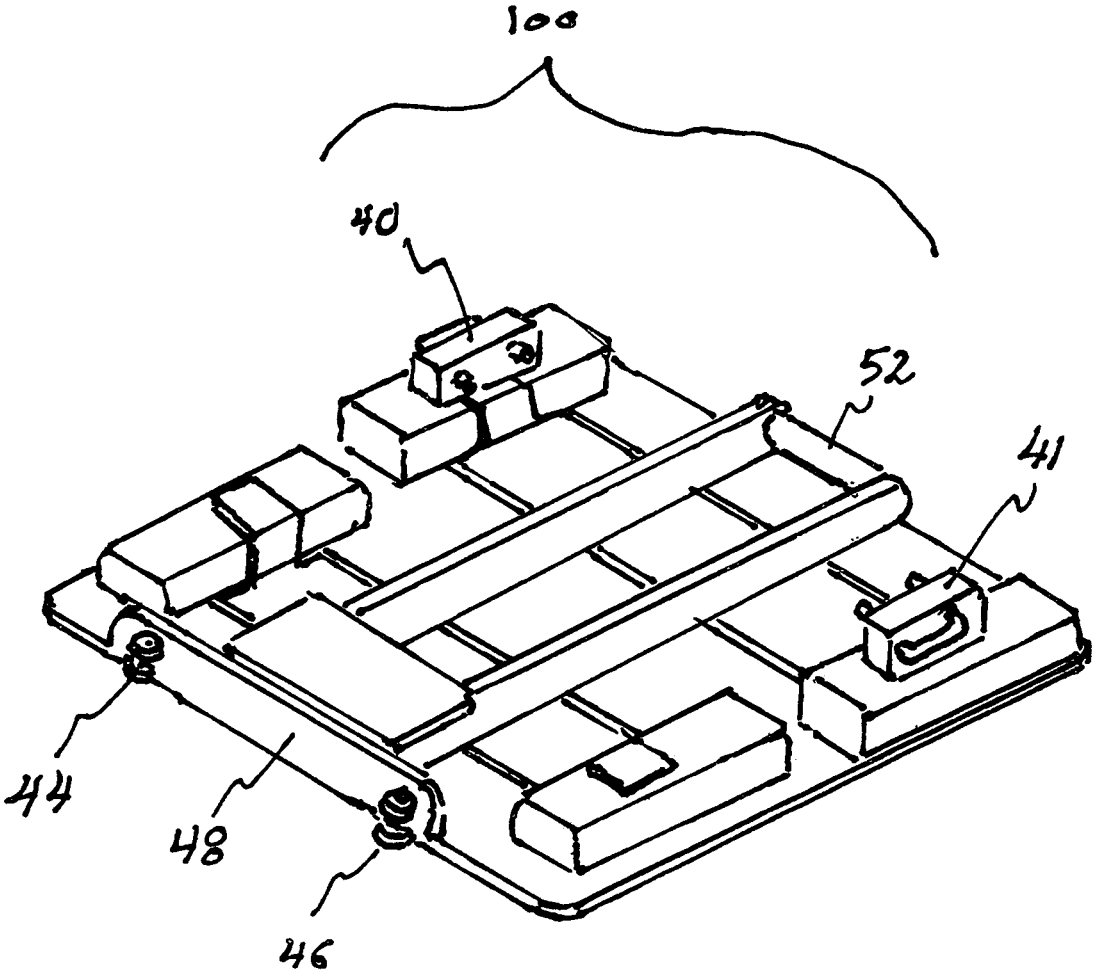
FIG. 6 is a perspective view of the invention with castors in place.

FIG. 6 also shows the casters 44, 46 and perpendicular plate 48 so that a person can tilt the entire assembly by ninety degrees and grasp the assembly by handle 52 and roll the entire assembly along the ground to a desired location.

Figure 7:
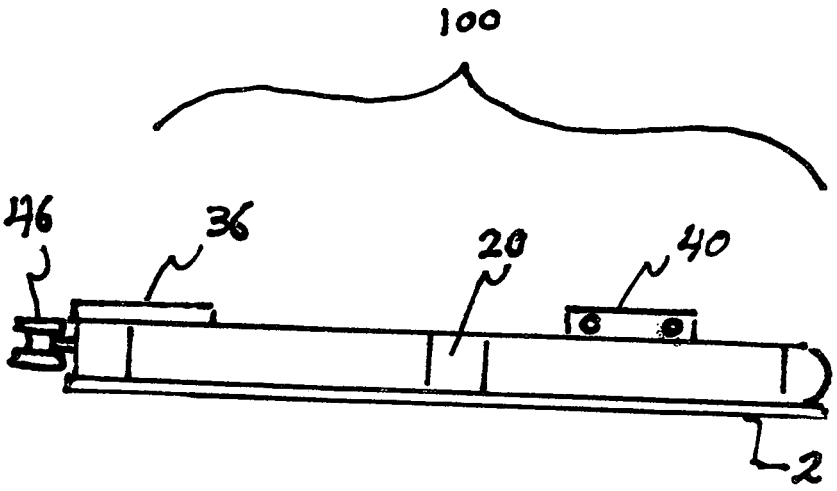
FIG. 7 is a side view of the invention in the lowered position.
Figure 8:
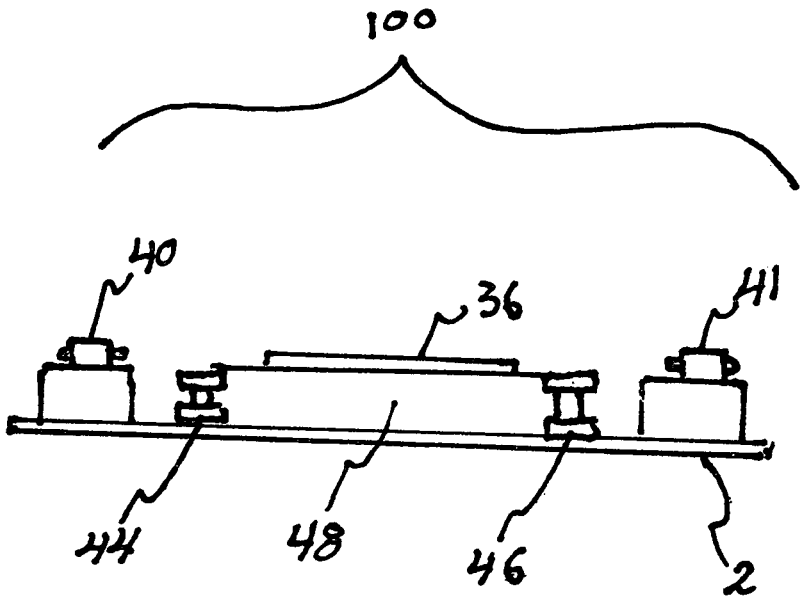
FIG. 8 is a front view of the invention in the lowered position.

FIG. 7 is a side view of the invention 100 in the lowered position and FIG. 8 is a rear end view of the invention 100 in the lowered position, both of which help further define and describe the invention 100.

The present invention can be used to assist someone getting from a wheel chair to a bed, exam table, X ray table, or vehicle. It can also be used to examine a patient's feet and provide foot care while the patient remains in the wheel chair. It could also be used to assist getting into a car or SUV where the patient can be raised or stand up on the lift plate so they do not have to use an unsteady step stool which they could fall off of. It can also be used by a patient who needs to sit at a higher position like when applying makeup, shaving or cooking in a kitchen. The invention can also be used by paraplegics who have use of their arms but cannot lift themselves into bed because of the higher elevation of the bed.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A wheel chair lifting device comprising:

a stationary platform;

a movable lift assembly;

four motorized scissors jacks;

a foot standing platform;

a battery power supply;

a wireless lift controller and receiver;

said four scissors jacks each placed on one corner of said stationary platform;

said movable lift assembly attached at each corner to said four scissors jacks;

said movable assembly capable of being lifted and lowered by said four scissors jacks;

said scissors jacks being powered by said battery power supply; and motors of said scissors jacks being activated by a wireless hand held controller;

the movable lift assembly includes a forwardly disposed panel and a rearwardly disposed panel;

a pair of rigid members connect the forwardly disposed panel and the rearwardly disposed panel;

the foot standing platform is attached to a forward end of the pair of rigid members;

four Z-shaped brackets connect the forwardly disposed panel and the rearwardly disposed panel to the scissors jacks; and the foot standing platform is hinged to allow access to the battery power supply and the receiver.

2. A wheel chair lifting device as claimed in claim 1 wherein said battery power supply and said wireless receiver are mounted to said stationary platform and positioned under said foot standing platform.

3. A wheel chair lifting device as claimed in claim 1 further comprising a carry handle mounted between a pair of rigid members.

4. A wheel chair lifting device as claimed in claim 1 further comprising a plurality of casters mounted to a perpendicularly disposed panel attached to said stationary platform.

5. A wheel chair lifting device as claimed in claim 1 wherein said wireless controller is a hand held device.

6. A wheel chair lifting device as claimed in claim 1 wherein said scissors jacks are each covered by hollow housings mounted to each said scissors jack.

* * * * *